US009907718B2

(12) United States Patent
Weitzel et al.

(10) Patent No.: US 9,907,718 B2
(45) Date of Patent: Mar. 6, 2018

(54) MATTRESS TOPPER, OCCUPANT SUPPORT ASSEMBLY AND OCCUPANT SUPPORT SYSTEM WITH THERMOSENSITIVE VAPOR TRANSFER CHARACTERISTICS

(71) Applicant: Hill-Rom Services, Inc., Batesville, IN (US)

(72) Inventors: Michelle E. Weitzel, Harrison, OH (US); Rachel Williamson, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 882 days.

(21) Appl. No.: 13/744,530

(22) Filed: Jan. 18, 2013

(65) Prior Publication Data

US 2014/0196216 A1 Jul. 17, 2014

Related U.S. Application Data

(60) Provisional application No. 61/751,322, filed on Jan. 11, 2013.

(51) Int. Cl.
*A47C 21/00* (2006.01)
*A61G 7/057* (2006.01)

(52) U.S. Cl.
CPC ..... *A61G 7/057* (2013.01); *A61G 7/05784* (2016.11); *A61G 2203/46* (2013.01)

(58) Field of Classification Search
CPC ..... A47C 21/00
USPC ..... 5/421–423, 713.726, 652.2
See application file for complete search history.

(56) References Cited

U.S. PATENT DOCUMENTS

2003/0087566 A1* 5/2003 Carlyle et al. ..... 442/59
2007/0032561 A1* 2/2007 Lin et al. ..... 521/131
2010/0175196 A1* 7/2010 Lafleche et al. ..... 5/707
2011/0258778 A1* 10/2011 Brykalski et al. ..... 5/421

OTHER PUBLICATIONS

Jinlian Hu; Shape memory textiles—Chapter 10; Shape memory polymers and textiles; The Textile Institute; Woodhead Publishing Limited, Cambridge, England; 2007.

* cited by examiner

*Primary Examiner* — Fredrick C Conley
(74) *Attorney, Agent, or Firm* — Kenneth C. Baran

(57) ABSTRACT

A nonintegrated mattress topper comprises a cover at least part of which comprises a fabric having a variable vapor transfer property. When the fabric temperature is within a first range consistent with the presence of an occupant on the mattress the fabric exhibits a first vapor transfer rate sufficiently high that the fabric is permeable to vapor transport across the fabric, and when the fabric temperature is lower than the first temperature range and consistent with the absence of an occupant the fabric exhibits a second vapor transfer rate lower than that of the first vapor transfer rate. Also disclosed is an occupant support assembly comprising a mattress and a nonintegrated topper having the variable vapor transfer property. Also disclosed is an occupant support system comprising a mattress and an integrated topper at least part of which is made of a fabric having the temperature dependent vapor permeability.

15 Claims, 8 Drawing Sheets

MATTRESS TOPPER, OCCUPANT SUPPORT ASSEMBLY AND OCCUPANT SUPPORT SYSTEM WITH THERMOSENSITIVE VAPOR TRANSFER CHARACTERISTICS

TECHNICAL FIELD

The subject matter described herein relates to a mattress topper, an occupant support assembly and an occupant support system having vapor transfer properties that vary as a function of temperature.

BACKGROUND

Beds such as those used in hospitals, other health care facilities and noninstitutional health care settings include a frame, a mattress supported by the frame, and may also employ a topper. A typical topper includes a fabric or fabric-like cover or ticking which bounds an interior volume. The cover has an interior surface which faces inwardly toward the interior volume and an exterior surface which faces outwardly toward the environment. The cover is customarily made of a vapor permeable hydrophilic material whose permeability or vapor transfer properties are substantially invariant with temperature.

One type of topper is a nonintegrated topper which may be installed on or removed from the mattress depending on the requirements of the bed occupant. Some mattresses include an integrated topper which is not readily removeable from the mattress.

One style of topper is a microclimate control topper, which may be of the nonintegrated or integrated type. During typical use of such a topper a stream of air flows through the interior volume of the topper generally from the foot end of the topper to the head end of the topper where the air is exhausted to atmosphere. When an occupant of the bed perspires on the topper the perspiration, which is mostly water, vaporizes and passes across the vapor permeable cover or ticking and into the airstream. The airstream carries the perspiration vapor (i.e. water vapor) out of the interior of the topper. As a result the topper counteracts any tendency for moisture to accumulate on the occupant's skin thereby enhancing occupant comfort and reducing the likelihood that the occupant will develop pressure ulcers.

As already noted the cover or ticking of the topper is customarily made of a hydrophilic, vapor permeable material so that perspiration vapor can readily migrate across the cover and into the airstream. The hydrophilic, vapor permeable properties of the topper are beneficial for withdrawing perspiration vapor. However when the topper is cleaned or sanitized with commonly used cleaning chemicals, these same properties can cause the cleaning chemicals to be absorbed, which causes degradation of the material. Materials which have lower vapor permeability may be more resistant to chemical degradation due to their lower liquid absorption characteristics, however a ticking made of such materials would have poorer perspiration vapor withdrawal capabilities than a ticking made of a material with higher vapor permeability. The designer is therefore faced with an undesirable tradeoff between cleanability and moisture vapor withdrawal capability.

SUMMARY

A mattress topper as disclosed herein comprises an exterior cover comprised of a top panel and a bottom panel. The cover defines an interior volume. A filler resides in the interior volume. At least part of the exterior cover is made of a fabric having a variable vapor transfer property such that when the temperature of the fabric is within a first temperature range consistent with the presence of an occupant on the mattress the fabric exhibits a first vapor transfer rate sufficiently high that the fabric is permeable to vapor transport across the fabric, and when the temperature of the fabric is lower than the first temperature range and consistent with the absence of an occupant the fabric exhibits a second vapor transfer rate lower than that of the first vapor transfer rate.

An occupant support assembly as disclosed herein comprises a mattress and a topper resting atop the mattress. The topper comprises an exterior cover having a top panel and a bottom panel. The cover defines an interior volume. A filler resides in the interior volume. At least part of the top panel is made of a fabric having a temperature dependent vapor permeability such that when the temperature of the fabric is within a first temperature range consistent with the presence of an occupant on the mattress the fabric exhibits a first vapor permeability sufficiently high that the fabric is permeable to vapor transport across the fabric, and when the temperature of the fabric is lower than the first temperature range and consistent with the absence of an occupant the fabric exhibits a second vapor permeability lower than the first vapor permeability.

An occupant support system as disclosed herein comprises a mattress, a filler material resting atop the mattress, and a coverlet resting atop the filler material. At least part of the coverlet is made of a fabric having a temperature dependent vapor permeability such that when the temperature of the fabric is within a first temperature range consistent with the presence of an occupant the fabric exhibits a first vapor permeability sufficiently high that the fabric is permeable to vapor transport across the fabric, and when the temperature of the fabric is lower than the first temperature range and consistent with the absence of an occupant the fabric exhibits a second vapor permeability lower than the first vapor permeability.

BRIEF DESCRIPTION OF THE DRAWINGS

The foregoing and other features of the various embodiments of the mattress topper, occupant support assembly and occupant support system described herein will become more apparent from the following detailed description and the accompanying drawings in which.

DETAILED DESCRIPTION

Figure 1:
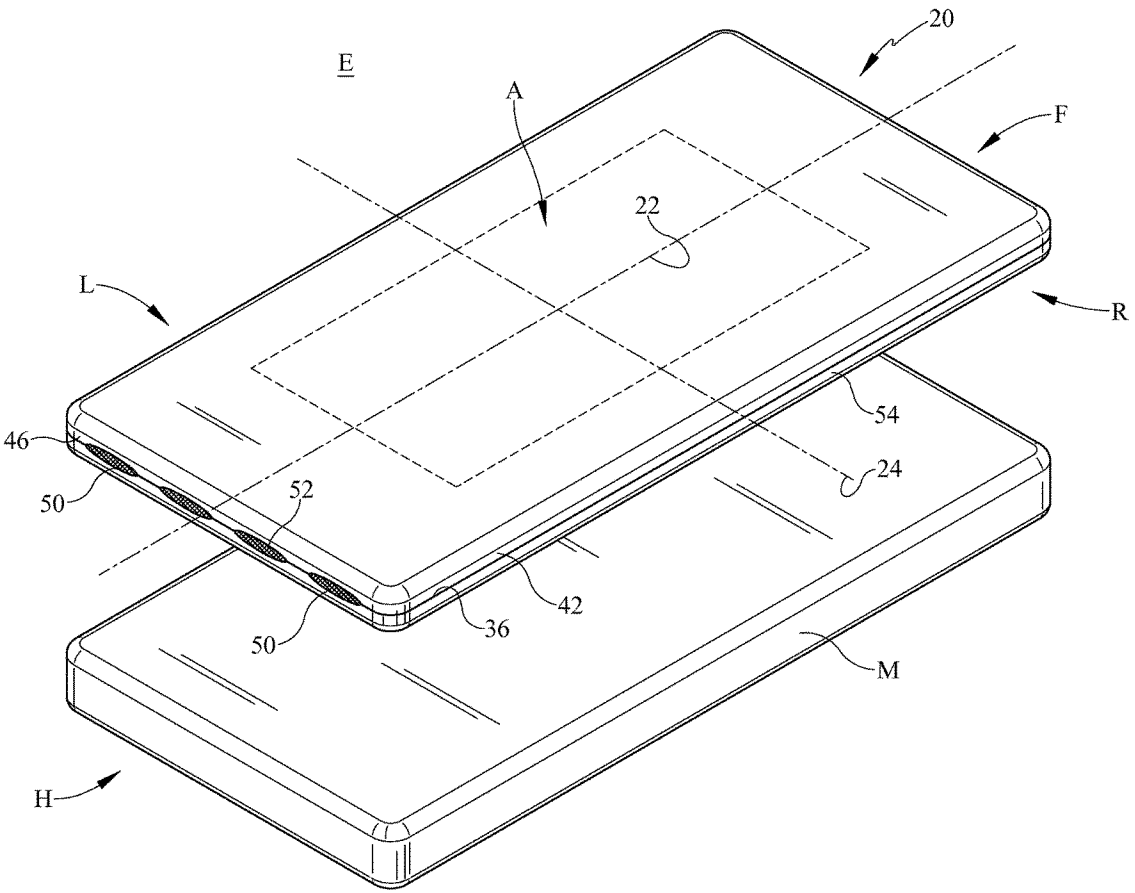
FIG. 1 is an exploded perspective view of a mattress and a nonintegrated mattress topper.
Figure 2:
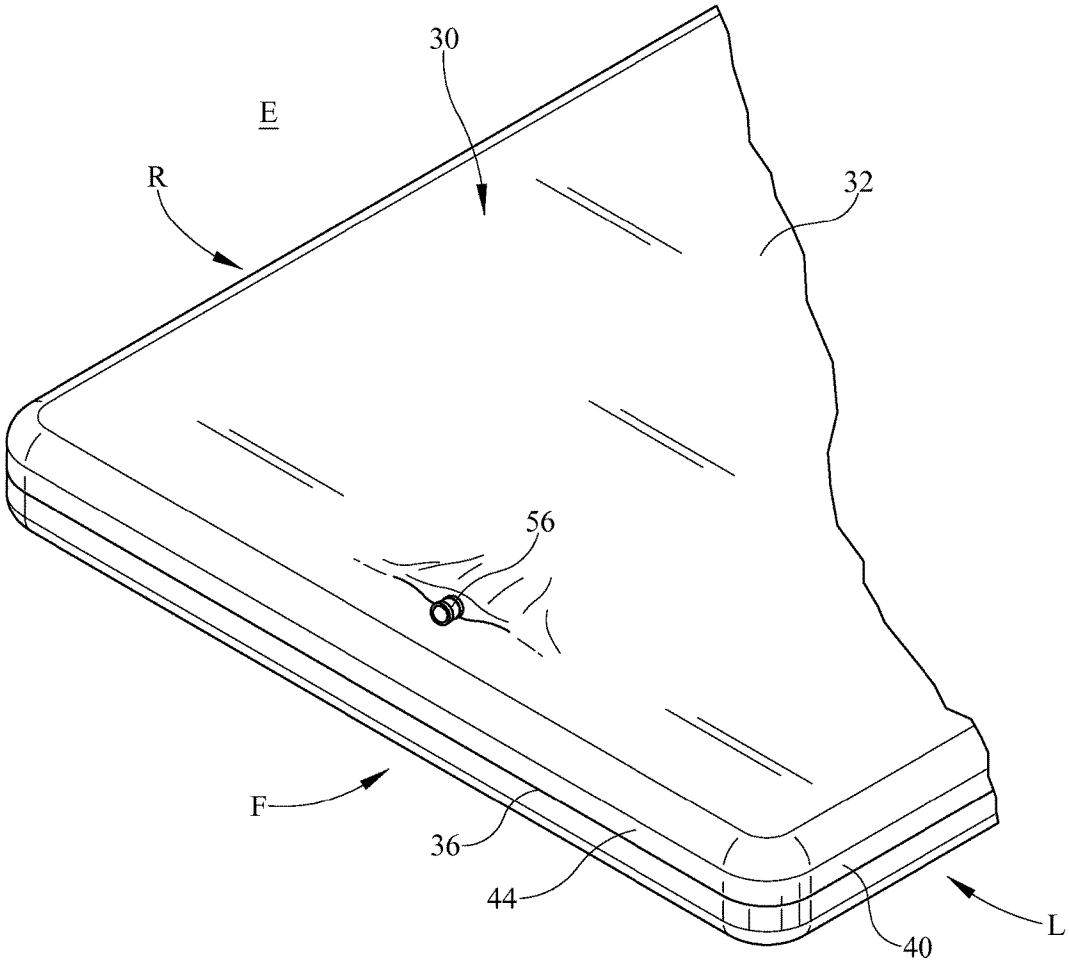
FIG. 2 is a fragmentary perspective view of the foot end of the topper of FIG. 1 showing a gas intake fitting for admitting a stream of gas into an interior region of the topper.
Figure 3:
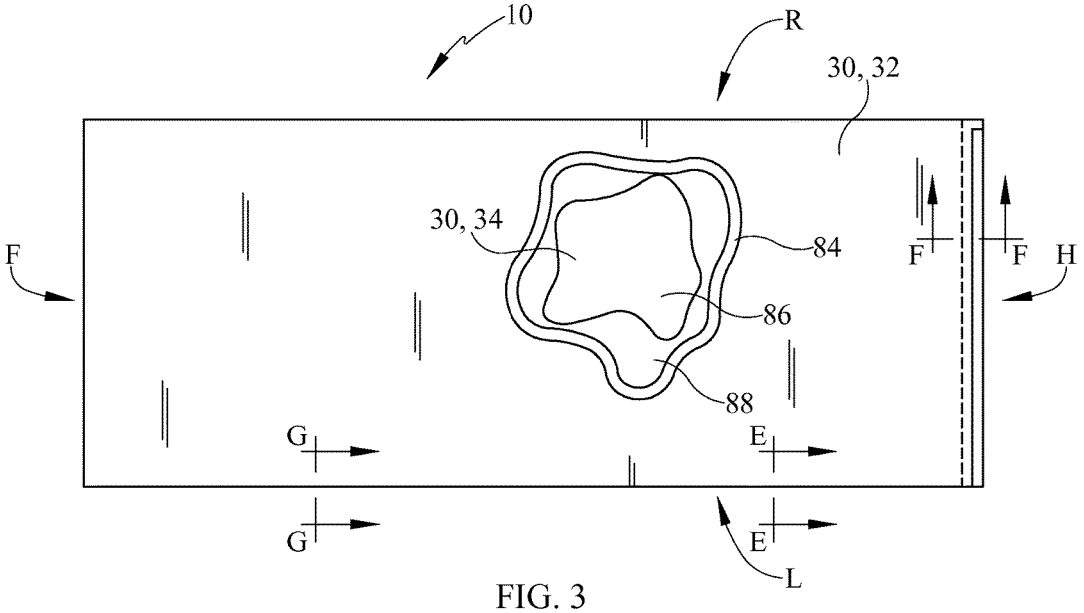
FIG. 3 is a plan view of the topper with components thereof selectively cut away.
Figure 4:
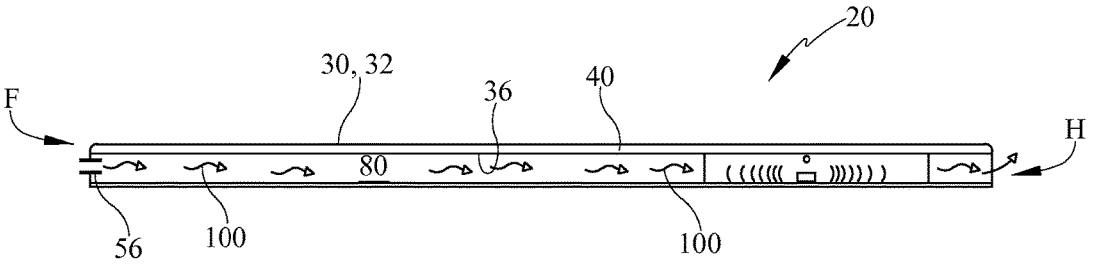
FIG. 4 is a left side elevation view of the topper.
Figure 6:
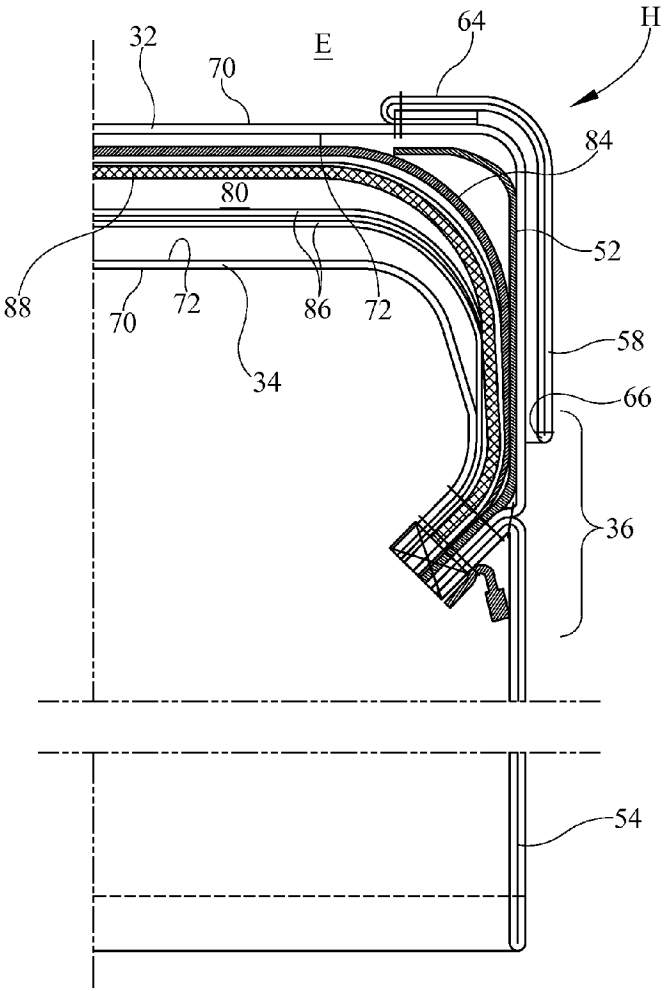
FIGS. 5, 6 and 7 are cross sectional views E-E, F-F and G-G respectively of FIG. 3.
Figure 5:
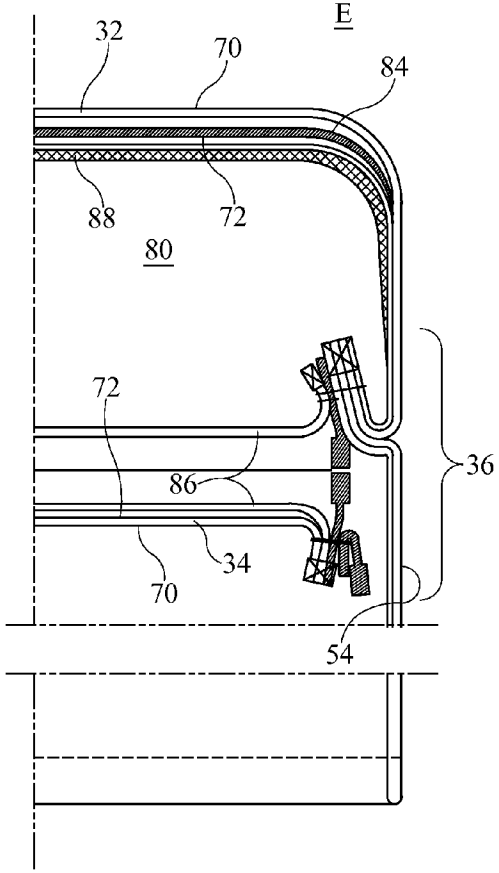
Figure 7:
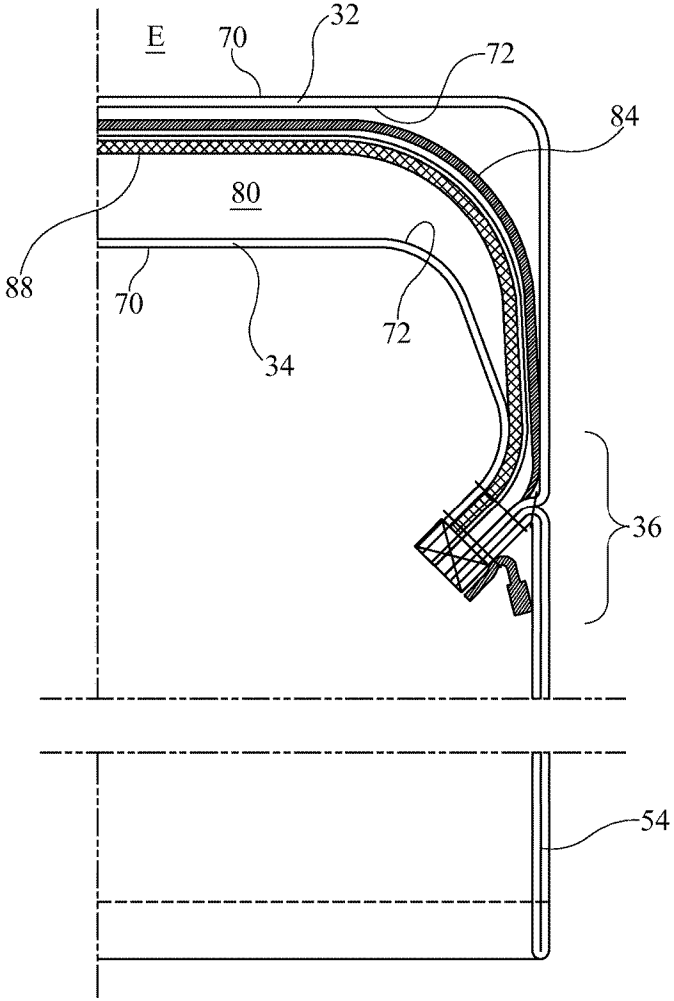

FIG. 1 shows a mattress M and an integrated topper 20 which extends laterally from a left side L to a right side R and longitudinally from a head end H to a foot end F. For reference the illustration also shows a longitudinally extending centerline 22 and a laterally extending centerline 24.

Referring additionally to FIGS. 2-7 the topper has an exterior cover 30 comprised of a top panel 32 and a bottom panel 34 joined together at a seam 36. The seam extends longitudinally along the left and right lateral edges 40, 42 of the topper and laterally along the foot edge 44 of the topper. The seam also extends laterally along the head edge 46 of the topper but is periodically interrupted to define a series of exhaust openings 50 seen best in FIG. 1. A highly porous mesh or net 52 (FIGS. 1, 6) covers the openings. A perimeter flap 54 also extends from the seam so that when the topper is installed on a mattress flap 54 drapes down along the sides of the mattress. Alternatively the topper could be manufactured without a seam (i.e. as a one-piece article) in which case the top panel 32 is the side of the topper intended to face the bed occupant and the bottom panel of the topper is the side of the topper intended to face the mattress. A gas intake fitting 56 (FIG. 2) penetrates through the topper cover near the foot end thereof. An exhaust flap 58, visible in FIG. 6 but not depicted in FIG. 1, has an attached end 64 attached to top panel 32 near the head end of the panel and a free end 66. The flap covers the exhaust openings to help keep contaminants out of the interior volume without substantially impeding gas flow out of the interior volume by way of the exhaust openings.

Each panel 32, 34, and therefore the topper as a whole, has an exterior surface 70 that faces the exterior environment E and an interior surface 72. The panels 32, 34 define an interior volume 80. The topper components within the interior volume include a fire barrier 84 and may also include an X-Ray sleeve 86. In addition, a filler 88 resides in the interior volume below the fire barrier. As used herein "filler" refers to a material other than a gas which does not offer substantial resistance to the flow of gas through the interior volume from a gas inlet (i.e. intake fitting 56) to a gas outlet (i.e. exhaust openings 50) even in the portion of the filler which is between the occupant and the mattress and therefore is subject to the weight of the occupant. In typical operation a blower, not shown, causes a stream of air 100 (FIG. 4) to flow through the topper interior volume from the intake 56 to the exhaust openings 50 and into the environment E. As already noted when an occupant of the bed perspires on the topper the perspiration, which is mostly water, vaporizes and migrates across the cover and into the airstream 100 which carries the perspiration vapor (i.e. water vapor) out of the interior of the topper to enhance occupant comfort and reduce the likelihood that the occupant will develop pressure ulcers.

Figure 8:
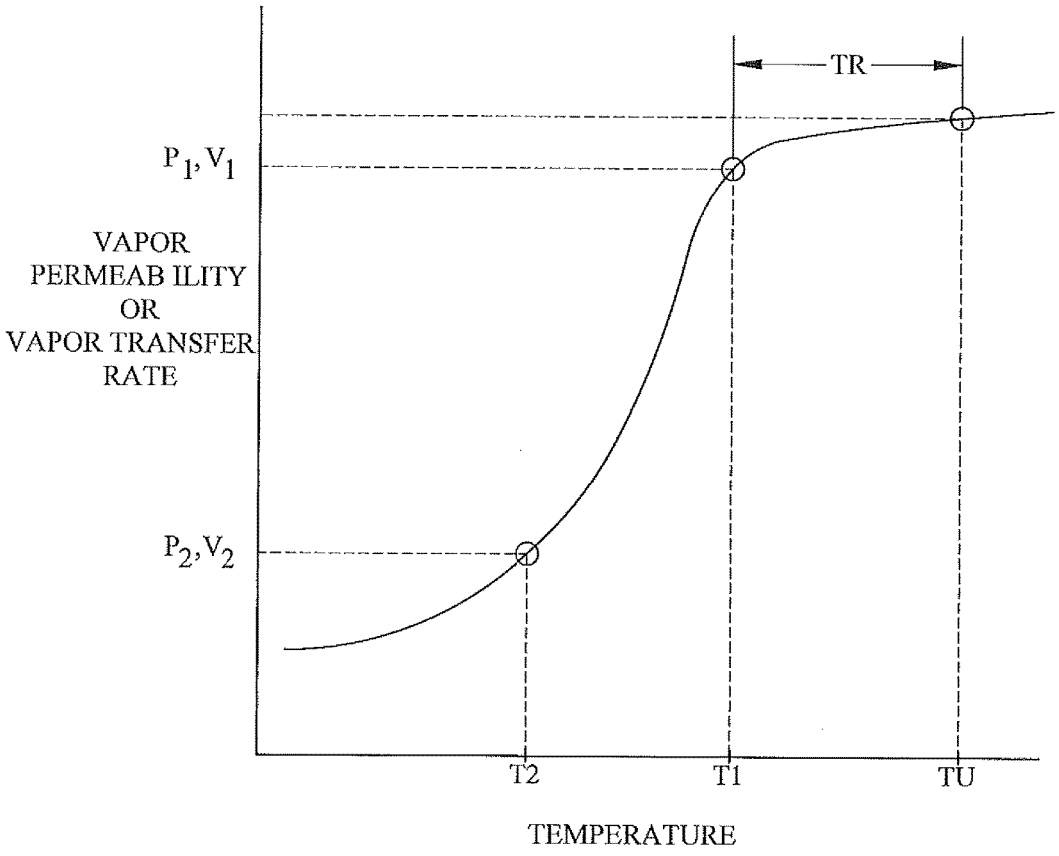
FIG. 8 is a graph schematically illustrating temperature dependent vapor permeability or vapor transfer rate of a material suitable for the topper.

Referring additionally to FIG. 8, at least part of exterior cover 30 comprises a fabric having a variable, temperature dependent vapor transfer property such that when the temperature of the fabric is within a first temperature range TR the fabric exhibits a first vapor transfer rate equal to at least V1 or, equivalently, a first vapor permeability of at least P1. The vapor transfer rate is a rate high enough to withdraw enough perspiration vapor from underneath the occupant, across the top panel 32, and into airstream 100, to reduce the occupant's susceptibility to developing pressure ulcers. Accordingly, temperature range TR is a range consistent with the presence of an occupant. In other words TR is the steady state temperature of the fabric resulting from heat transfer from a bed occupant. The lower and upper bounds T1, $T_U$ of temperature range TR are low enough and high enough respectively that a large percentage of occupants (for example three or four standard deviations) will benefit from the corresponding high vapor transfer rates. However when the temperature of the fabric is a temperature T2 lower than the first temperature range and consistent with the absence of an occupant, the fabric exhibits a second vapor transfer rate V2 or second vapor permeability P2 lower than that of the first vapor transfer rate. T2 is low enough relative to T1 to be a strong indicator that an occupant is not present. The accompanying lower permeability to liquid transfer allows the topper to be cleaned without undue risk that the cleaning chemicals will degrade the topper material.

The fabric is referred to hereinafter as a thermosensitive fabric. Vapor transfer rate is a measure of the maximum mass of vapor per unit surface area per unit time that can migrate across the fabric. When used herein in the context of vapor transfer the word "across" refers to vapor migration in a direction from the environment E to the interior volume 80 rather than in a direction perpendicular to the plane of FIGS. 5, 6, 7. As used herein, "occupant presence" and similar terms refer to a condition in which the occupant is at least partially supported by the mattress (e.g. the occupant is lying or sitting on the mattress) as opposed to merely being in the vicinity of the mattress. Conversely, "occupant absence" and similar terms refer to a condition in which the occupant is not at least partially supported by the mattress.

In one variant the second vapor transfer rate is sufficiently low that the fabric is substantially impermeable to vapor transport across the fabric.

The entire exterior cover, i.e. the entire top and bottom panel 32, 34, may be made of the thermosensitive fabric. In another alternative only the top panel 32 is made of the thermosensitive fabric. In yet another alternative only part of the top panel is made of the thermosensitive fabric, for example the area A (FIG. 1) where the occupant would normally be positioned.

Figure 9:
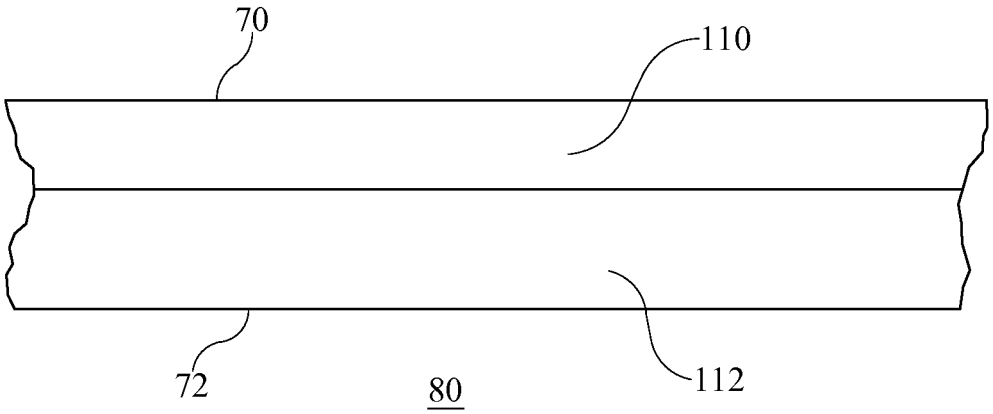
FIG. 9 is a schematic cross sectional elevation view of a fabric suitable for the topper and comprised of a shape memory hydrophillic polyurethane layer and a substrate fabric layer.
Figure 10:
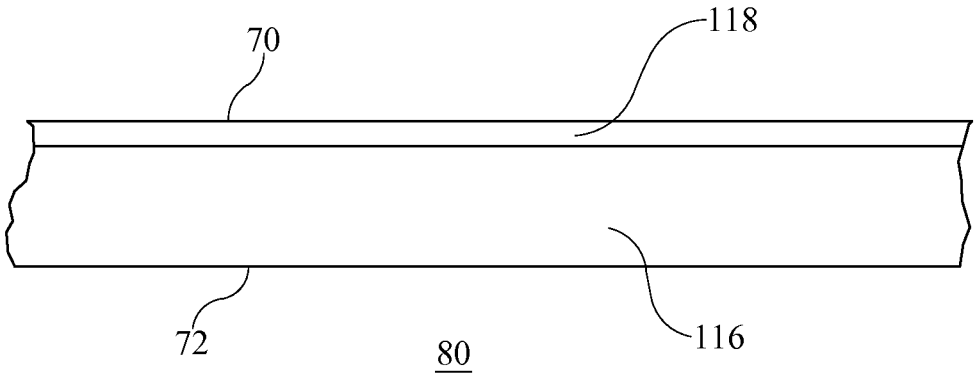
FIG. 10 is a schematic cross sectional elevation view of a fabric suitable for the topper and comprised of a shape memory polyurethane coating and a substrate layer.

In an example embodiment shown in FIG. 9 the thermosensitive fabric is a shape memory hydrophilic polyurethane 110 laminated to a substrate fabric 112 such as nylon and arranged such that the substrate layer 112 is the interior surface 72 and the polyurethane layer is the exterior surface 70. In another embodiment (FIG. 10) the fabric comprises a substrate 116 coated with a shape memory polyurethane coating 118 arranged such that the substrate layer 116 is the interior surface 72 and the polyurethane coating is the exterior surface 70. Other thermosensitive materials may also be satisfactory for imparting the desired thermosensitivity to the topper cover. One such material is known as DIAPLEX®, which is a registered trademark of Mitsubishi Shoji Fashion Kabushiki Kaisha.

In another embodiment the cover may also comprise a color variable material or coating which changes color as a function of temperature such that the cover has a first perceivable color when the temperature of the fabric is within the first temperature range TR and a second perceivable color, different than the first perceivable color, when the temperature of the fabric is lower than the first temperature range, for example at temperature T2. The color variability may be useful to the caregiver staff to indicate whether or not the cover is at a temperature consistent with high rates of vapor transfer. The color variability may also be useful to the caregiver and/or housekeeping staff to indicate whether or not the cover is at a temperature at which it can be cleaned with minimal risk of being damaged by the cleaning chemicals. One example color variable material is known as Chromyx™, which is a trademark of Chameleon International.

Taken together, mattress M and nonintegrated topper define an occupant support assembly. In other words the occupant support assembly includes mattress M and the topper 20 resting atop the mattress. As previously noted, the topper comprises an exterior cover 30 having a top panel 32 and a bottom panel 34. The top and bottom panels may be joined together at a seam 36 or the cover may be a unitary, single piece construction. Either way the panels define an interior volume 80. A filler 88 resides in the interior volume. At least part of the top panel comprises a fabric having a temperature dependent vapor permeability such that when the temperature of the fabric is within a first temperature range consistent with the presence of an occupant the fabric exhibits a first vapor permeability sufficiently high that the fabric is permeable to vapor transport across the fabric and when the temperature of the fabric is lower than the first temperature range and consistent with the absence of an occupant the fabric exhibits a second vapor permeability lower than the first vapor permeability.

Figure 11:
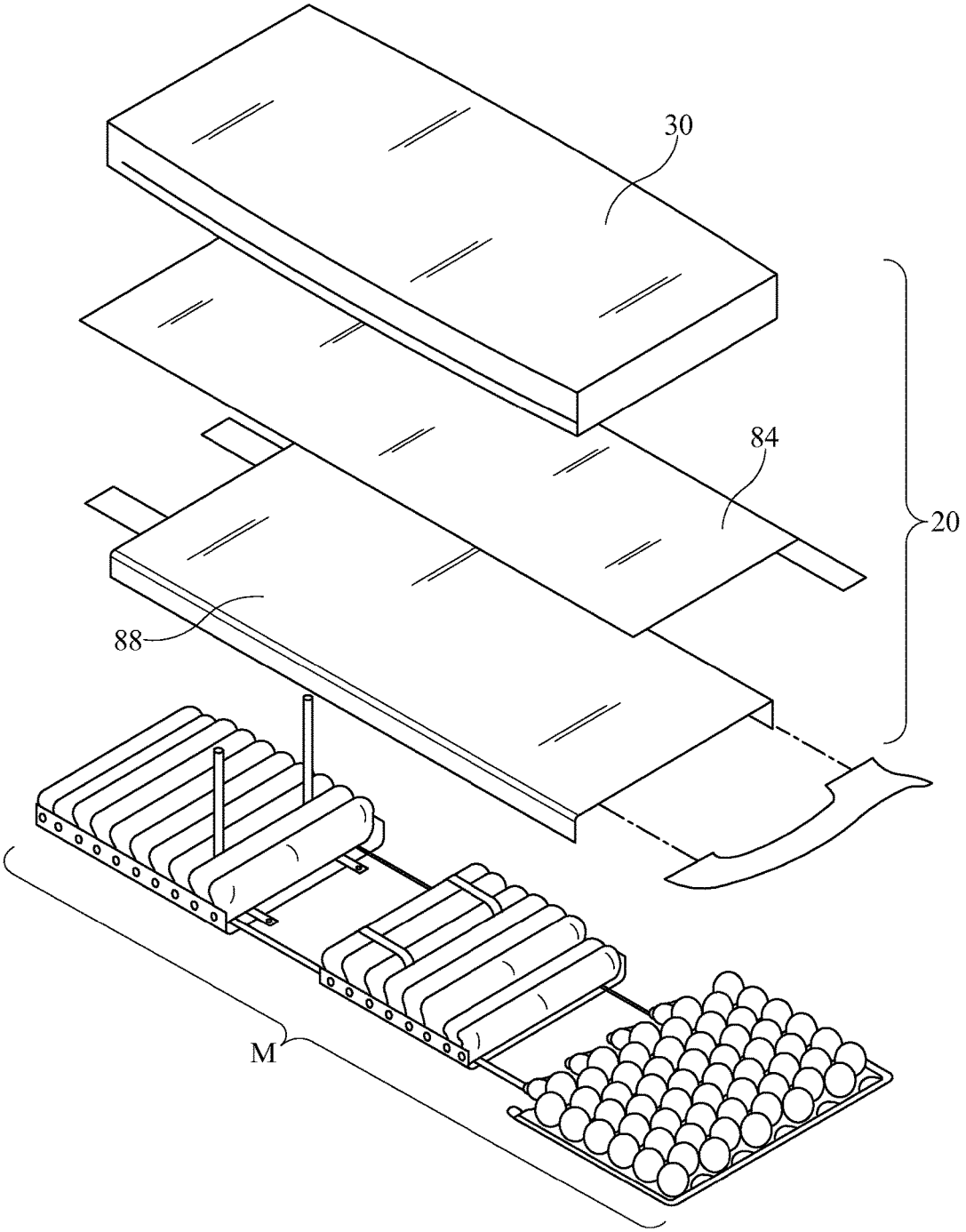
FIG. 11 is an exploded perspective view of an occupant support system comprising a mattress and an integrated topper.

FIG. 11 shows an occupant support system having an integrated topper. Features similar to or the same as features already described are identified by the same reference numerals already used. The occupant support system comprises a mattress M having an integrated topper 20. A filler material 88 rests atop the mattress. A coverlet 30 rests atop the filler material. At least part of the coverlet comprises a fabric having a temperature dependent vapor permeability such that when the temperature of the fabric is within a first temperature range TR consistent with the presence of an occupant the fabric exhibits a first vapor permeability sufficiently high that the fabric is permeable to vapor transport across the fabric and when the temperature of the fabric is a temperature T2 lower than the first temperature range TR and consistent with the absence of an occupant the fabric exhibits a second vapor permeability lower than the first vapor permeability.

Although the foregoing description has been presented in the context of water vapor or perspiration vapor, the concepts disclosed are also applicable to other vapors (e.g. vapors of urine and blood) even though those other vapors may require different values of permeability or vapor transfer rate P1, P2, V1, V2.

Although the foregoing description has been presented in the context of a microclimate control toppers, the concepts disclosed herein are also applicable to toppers and tickings that do not possess microclimate control capabilities.

Although this disclosure refers to specific embodiments, it will be understood by those skilled in the art that various changes in form and detail may be made without departing from the subject matter set forth in the accompanying claims.

We claim:

1. A mattress topper comprising:

an exterior cover comprised of a top panel and a bottom panel, the cover defining an interior volume, and a filler residing in the interior volume, at least part of the exterior cover comprising a fabric having a variable vapor transfer property such that when the temperature of the fabric is within a first temperature range consistent with the presence of an occupant the fabric exhibits a first vapor transfer rate sufficiently high that the fabric is permeable to vapor transport across the fabric, and when the temperature of the fabric is lower than the first temperature range and consistent with the absence of an occupant the fabric exhibits a second vapor transfer rate lower than the first vapor transfer rate and sufficiently low that the fabric is substantially impermeable to vapor transport across the fabric.

2. A mattress topper comprising:

an exterior cover comprised of a top panel and a bottom panel, the cover defining an interior volume, and a filler residing in the interior volume, at least part of the exterior cover comprising a fabric having a variable vapor transfer property such that when the temperature of the fabric is within a first temperature range consistent with the presence of an occupant the fabric exhibits a first vapor transfer rate sufficiently high that the fabric is permeable to vapor transport across the fabric, and when the temperature of the fabric is lower than the first temperature range and consistent with the absence of an occupant the fabric exhibits a second vapor transfer rate lower than the first vapor transfer rate, wherein the fabric is substantially impermeable to liquid transport at the lower temperature and is less impermeable to liquid transport within the first temperature range.

3. A mattress topper comprising:

an exterior cover comprised of a top panel and a bottom panel, the cover defining an interior volume, and a filler residing in the interior volume, at least part of the exterior cover comprising a fabric having a variable vapor transfer property such that when the temperature of the fabric is within a first temperature range consistent with the presence of an occupant the fabric exhibits a first vapor transfer rate sufficiently high that the fabric is permeable to vapor transport across the fabric, and when the temperature of the fabric is lower than the first temperature range and consistent with the absence of an occupant the fabric exhibits a second vapor transfer rate lower than the first vapor transfer rate, wherein the fabric is substantially impermeable to liquid transport within the first temperature range and at the lower temperature.

4. A mattress topper comprising:

an exterior cover comprised of a top panel and a bottom panel, the cover defining an interior volume, and a filler residing in the interior volume, at least part of the exterior cover comprising a fabric having a variable vapor transfer property such that when the temperature of the fabric is within a first temperature range consistent with the presence of an occupant the fabric exhibits a first vapor transfer rate sufficiently high that the fabric is permeable to vapor transport across the fabric, and when the temperature of the fabric is lower than the first temperature range and consistent with the absence of an occupant the fabric exhibits a second vapor transfer rate lower than the first vapor transfer rate, wherein the fabric comprises a shape memory hydrophilic polyurethane laminated to a substrate fabric and arranged such that the substrate layer is an interior layer and the polyurethane layer is an exterior layer.

5. A mattress topper comprising:

an exterior cover comprised of a top panel and a bottom panel, the cover defining an interior volume, and a filler residing in the interior volume, at least part of the exterior cover comprising a fabric having a variable vapor transfer property such that when the temperature of the fabric is within a first temperature range consistent with the presence of an occupant the fabric exhibits a first vapor transfer rate sufficiently high that the fabric is permeable to vapor transport across the fabric, and when the temperature of the fabric is lower than the first temperature range and consistent with the absence of an occupant the fabric exhibits a second vapor transfer rate lower than the first vapor transfer rate, and wherein the fabric comprises a substrate and a shape memory polyurethane coating.

6. An occupant support assembly comprising:

a mattress and a topper resting atop the mattress, the topper comprising an exterior cover having a top panel and a bottom panel, which define an interior volume, and a filler residing in the interior volume, at least part of the top panel comprising a fabric having a temperature dependent vapor permeability property such that when the temperature of the fabric is within a first temperature range consistent with the presence of an occupant the fabric exhibits a first vapor permeability sufficiently high to accommodate vapor transport across the fabric, and when the temperature of the fabric is lower than the first temperature range and consistent with the absence of an occupant the fabric exhibits a second vapor permeability lower than the first vapor permeability and sufficiently low that the fabric is substantially impermeable to vapor transport across the fabric.

7. An occupant support assembly comprising:

a mattress and a topper resting atop the mattress, the topper comprising an exterior cover having a top panel and a bottom panel, which define an interior volume, and a filler residing in the interior volume, at least part of the top panel comprising a fabric having a temperature dependent vapor permeability property such that when the temperature of the fabric is within a first temperature range consistent with the presence of an occupant the fabric exhibits a first vapor permeability sufficiently high to accommodate vapor transport across the fabric, and when the temperature of the fabric is lower than the first temperature range and consistent with the absence of an occupant the fabric exhibits a second vapor permeability lower than the first vapor permeability, wherein the fabric is substantially impermeable to liquid transport across the fabric at the lower temperature and is less impermeable to liquid transport within the first temperature range.

8. An occupant support assembly comprising:

a mattress and a topper resting atop the mattress, the topper comprising an exterior cover having a top panel and a bottom panel, which define an interior volume, and a filler residing in the interior volume, at least part of the top panel comprising a fabric having a temperature dependent vapor permeability property such that when the temperature of the fabric is within a first temperature range consistent with the presence of an occupant the fabric exhibits a first vapor permeability sufficiently high to accommodate vapor transport across the fabric, and when the temperature of the fabric is lower than the first temperature range and consistent with the absence of an occupant the fabric exhibits a second vapor permeability lower than the first vapor permeability, wherein the fabric is substantially impermeable to liquid transport across the fabric within both the first temperature range and at the lower temperature.

9. An occupant support assembly comprising:

a mattress and a topper resting atop the mattress, the topper comprising an exterior cover having a top panel and a bottom panel, which define an interior volume, and a filler residing in the interior volume, at least part of the top panel comprising a fabric having a temperature dependent vapor permeability property such that when the temperature of the fabric is within a first temperature range consistent with the presence of an occupant the fabric exhibits a first vapor permeability sufficiently high to accommodate vapor transport across the fabric, and when the temperature of the fabric is lower than the first temperature range and consistent with the absence of an occupant the fabric exhibits a second vapor permeability lower than the first vapor permeability, wherein the fabric comprises a shape memory hydrophilic polyurethane laminated to a substrate fabric and arranged such that the substrate layer is an interior layer and the polyurethane layer is an exterior layer.

10. An occupant support assembly comprising:

a mattress and a topper resting atop the mattress, the topper comprising an exterior cover having a top panel and a bottom panel, which define an interior volume, and a filler residing in the interior volume, at least part of the top panel comprising a fabric having a temperature dependent vapor permeability property such that when the temperature of the fabric is within a first temperature range consistent with the presence of an occupant the fabric exhibits a first vapor permeability sufficiently high to accommodate vapor transport across the fabric, and when the temperature of the fabric is lower than the first temperature range and consistent with the absence of an occupant the fabric exhibits a second vapor permeability lower than the first vapor permeability, and wherein the fabric comprises a substrate and a shape memory polyurethane coating.

11. An occupant support system comprising:

a mattress, a filler material resting atop the mattress, and a coverlet resting atop the filler material, at least part of the the coverlet comprising a fabric having a temperature dependent vapor permeability property such that when the temperature of the fabric is within a first temperature range consistent with the presence of an occupant the fabric exhibits a first vapor permeability sufficiently high to accommodate vapor transport across the fabric, and when the temperature of the fabric is lower than the first temperature range and consistent with the absence of an occupant the fabric exhibits a second vapor permeability lower than the first vapor permeability and sufficiently low that the fabric is substantially impermeable to vapor transport across the fabric.

12. An occupant support system comprising:

a mattress, a filler material resting atop the mattress, and a coverlet resting atop the filler material, at least part of the the coverlet comprising a fabric having a temperature dependent vapor permeability property such that when the temperature of the fabric is within a first temperature range consistent with the presence of an occupant the fabric exhibits a first vapor permeability sufficiently high to accommodate vapor transport across the fabric, and when the temperature of the fabric is lower than the first temperature range and consistent with the absence of an occupant the fabric exhibits a second vapor permeability lower than the first vapor permeability, wherein the fabric is substantially impermeable to liquid transport across the fabric at the lower temperature and is less impermeable to liquid transport within the first temperature range.

13. An occupant support system comprising:

a mattress, a filler material resting atop the mattress, and a coverlet resting atop the filler material, at least part of the the coverlet comprising a fabric having a temperature dependent vapor permeability property such that when the temperature of the fabric is within a first temperature range consistent with the presence of an occupant the fabric exhibits a first vapor permeability sufficiently high to accommodate vapor transport across the fabric, and when the temperature of the fabric is lower than the first temperature range and consistent with the absence of an occupant the fabric exhibits a second vapor permeability lower than the first vapor permeability, wherein the fabric is substantially impermeable to liquid transport across the fabric within both the first temperature range and at the lower temperature.

14. An occupant support system comprising:

a mattress, a filler material resting atop the mattress, and a coverlet resting atop the filler material, at least part of the the coverlet comprising a fabric having a temperature dependent vapor permeability property such that when the temperature of the fabric is within a first temperature range consistent with the presence of an occupant the fabric exhibits a first vapor permeability sufficiently high to accommodate vapor transport across the fabric, and when the temperature of the fabric is lower than the first temperature range and consistent with the absence of an occupant the fabric exhibits a second vapor permeability lower than the first vapor permeability, wherein the fabric comprises a shape memory hydrophilic polyurethane laminated to a substrate fabric and arranged such that the substrate layer is an interior layer and the polyurethane layer is an exterior layer.

15. An occupant support system comprising:

a mattress, a filler material resting atop the mattress, and a coverlet resting atop the filler material, at least part of the the coverlet comprising a fabric having a temperature dependent vapor permeability property such that when the temperature of the fabric is within a first temperature range consistent with the presence of an occupant the fabric exhibits a first vapor permeability sufficiently high to accommodate vapor transport across the fabric, and when the temperature of the fabric is lower than the first temperature range and consistent with the absence of an occupant the fabric exhibits a second vapor permeability lower than the first vapor permeability, and wherein the fabric comprises a substrate and a shape memory polyurethane coating to the substrate.

* * * * *